US005129382A

United States Patent [19]

Stamps, Sr. et al.

[11] Patent Number: 5,129,382

[45] Date of Patent: Jul. 14, 1992

[54] COMBUSTION EFFICIENCY IMPROVEMENT DEVICE

[75] Inventors: Roy D. Stamps, Sr.; Arthur C. Williams, Sr., both of Nashville, Tenn.

[73] Assignee: Eagle Research and Development, Inc., Nashville, Tenn.

[21] Appl. No.: 581,365

[22] Filed: Sep. 12, 1990

[51] Int. Cl.[5] ..... F02M 33/00

[52] U.S. Cl. ..... 123/536; 123/537; 123/538

[58] Field of Search ..... 123/536, 537, 538, 539

[56] References Cited

U.S. PATENT DOCUMENTS

| | | | |
|---|---|---|---|
| 3,116,726 | 1/1964 | Kwartz . | |
| 3,228,868 | 1/1966 | Ruskin et al. . | |
| 3,349,354 | 10/1967 | Miyata | 123/536 |
| 3,830,621 | 8/1974 | Miller | 123/539 |
| 3,989,017 | 11/1976 | Reece . | |
| 4,005,683 | 2/1977 | Whitt . | |
| 4,050,426 | 9/1977 | Sanderson . | |
| 4,188,296 | 2/1980 | Fujita . | |
| 4,308,847 | 1/1982 | Ruizzo, Jr. . | |
| 4,334,887 | 6/1982 | Takabayashi | 123/538 |
| 4,381,754 | 5/1983 | Heckel . | |
| 4,414,951 | 11/1983 | Saneto | 123/538 |
| 4,461,262 | 7/1984 | Chow . | |
| 4,469,076 | 9/1984 | Wolff . | |
| 4,538,582 | 9/1985 | Wakuta | 123/538 |
| 4,572,145 | 2/1986 | Mitchell et al. . | |

*Primary Examiner*—E. Rollins Cross
*Assistant Examiner*—M. Macy
*Attorney, Agent, or Firm*—Oliff & Berridge

[57] ABSTRACT

A device for improving combustion efficiency comprises one or more magnets for negatively charging fluid fed through a fluid passageway to a combustion chamber of a combustion apparatus. The device includes a housing containing a permanent magnet assembly having at least one magnet positioned adjacent the fluid passageway. The magnet is arranged with its north pole closer to the fluid passageway than its south pole, and preferably with its north pole between the fluid passageway and the south pole. The device improves fuel efficiency, increases power production, reduces carbon build-up on engine parts and reduces pollutants in exhaust emissions.

5 Claims, 3 Drawing Sheets

COMBUSTION EFFICIENCY IMPROVEMENT DEVICE

BACKGROUND OF THE INVENTION

The present invention relates to a magnetic device and method for improving combustion efficiency in combustion apparatus such as, for example, internal combustion engines.

Two of the greatest ecological concerns the world faces are fuel economy and pollution, particularly polluting emissions from internal combustion engines.

When a hydrocarbon fuel is mixed with oxygen and burned in an internal combustion engine such as a gasoline engine, a diesel engine, a jet engine, a gas turbine or a gas burner, the combustion may be inefficient or incomplete causing excessive fuel consumption and release of polluting emissions into the atmosphere. This inefficiency also causes reduced life of the engine and its working parts because of carbon buildup on the mechanical parts.

The world is beginning to realize that there is not an endless supply of fuel in the earth. As a result, the cost of fuel keeps increasing and the need to conserve fuel has become more important than ever. The use of magnetism to improve fuel combustion has been somewhat successful and is documented in a number of U.S. patents.

U.S. Pat. No. 4,461,262 discloses a fuel treatment device comprising a pair of magnets positioned at an inlet for incoming fuel. Each of the magnets is positioned with a south magnetic pole placed upstream of a fuel line and a north magnetic pole placed closest to a mixing zone. Fuel passes initially through the flux of the opposed south poles, and then through the flux of the opposed north poles.

U.S. Pat. No. 4,572,145 discloses a magnetic fuel treatment device comprising a magnet imbedded in a U-shaped body of non-magnetic material adapted to fit over a fuel line. The magnet is positioned so that its north pole is spaced apart from the fuel line and its south pole is adjacent the fuel line.

U.S. Pat. No 4,188,296 discloses a magnetizing apparatus used to apply a magnetic field to fuel to impart a magnetic flux density of at least 10 gauss to the fuel. A plurality of magnets are disposed within a casing and oriented such that the magnetic force produced from the magnets flows along loops as shown in FIG. 2.

Although some of these devices have served to improve combustion efficiency, there remains a need for even better combustion so as to further reduce emissions and fuel consumption.

SUMMARY OF THE INVENTION

It is therefore an object of the present invention to provide a device for a combustion apparatus which is easy to install and which improves fuel economy and reduces polluting emissions.

It is another object of this invention to provide a magnetizing device of a simple construction for applying a magnetic field to fluid used in a combustion apparatus so as to improve combustion.

It is yet another object of the present invention to provide a method of improving combustion so as to increase fuel economy and power and reduce polluting emissions.

These and other objects of the present invention are accomplished by a device comprising a fluid passageway accommodating portion and at least one magnet oriented such that a north pole of the magnet is adjacent the fluid passageway accommodating portion and a south pole of the magnet is on an opposite side of the north pole from the fluid passageway accommodating portion. The present invention further provides a method which uses such a device to negatively charge fluid for combustion in a combustion apparatus.

In accordance with another aspect of the present invention, the fluid passageway accommodating portion and the magnet are encased in a housing.

In accordance with other aspects of the invention, a cover is placed over the housing to secure the housing to a fluid passageway and/or other means are provided for attaching the device to a fluid passageway.

In accordance with another aspect of the present invention, the device is installed on a fluid passageway as close as possible to the combustion apparatus.

In accordance with other aspects of the present invention, the device is positioned on a fuel line or an air intake line.

In accordance with other aspects of the present invention, the magnet is either a permanent magnet or an electromagnet.

In accordance with another aspect of the present invention, two magnets are positioned diametrically opposed on opposite sides of a fluid passageway accommodating portion.

In accordance with other aspects of the present invention the material for the magnet(s) and the curie temperature are specified.

The present invention further relates to a combustion efficiency improvement device comprising a combustion apparatus, a fluid passageway leading to the combustion apparatus and at least one magnet oriented with respect to the fluid passageway as discussed above.

BRIEF DESCRIPTION OF THE DRAWINGS

The above and other features and objects of the invention will be better understood from the following detailed description of the invention illustrated in the accompanying drawings in which.

DETAILED DESCRIPTION OF THE PREFERRED EMBODIMENTS

Figure 1:
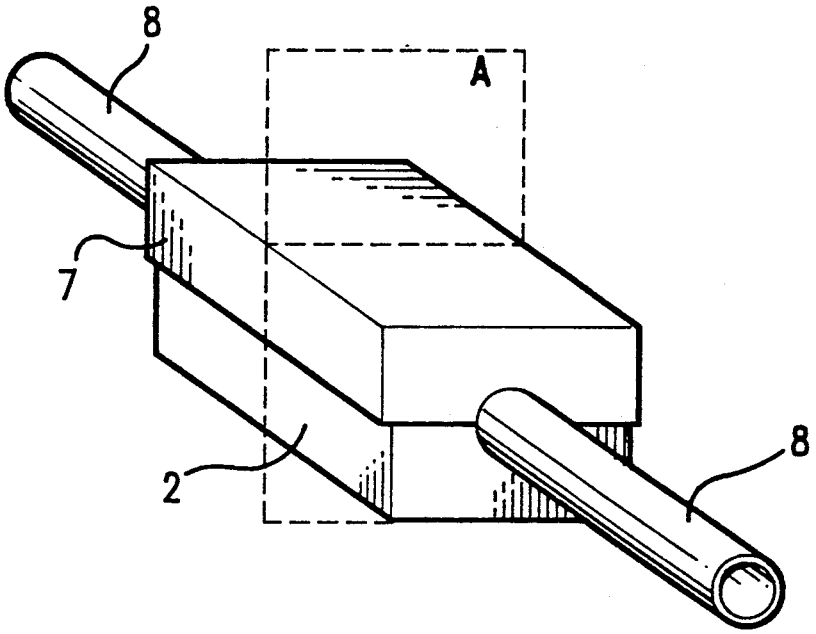
FIG. 1 is a perspective view of a combustion efficiency improvement device according to the present invention.

In accordance with the present invention, a device and method are provided which improve combustion efficiency in a combustion apparatus, such as an internal combustion engine.

The device can be used on all internal combustion engines, whether new or existing, and functions efficiently, effectively and reliably in the reduction and elimination of polluting emissions to assist in meeting both Federal and State Pollution Control regulations. The device may be readily retrofit to any internal combustion engine. Installation takes only a matter of minutes without modification to existing equipment. Also, improved gas economy and power production may be realized through the use of devices and methods according to the present invention.

In contrast with other fuel saving units, no cutting of the fuel line and no hose or clamps are necessary to install the present invention.

The device comprises at least one magnet which is positioned on a fluid passageway such as a passageway that carries fuel, air, etc. to a combustion chamber of the combustion apparatus. The magnet is positioned such that a north pole of the magnet is adjacent the fluid passageway and a south pole of the magnet is positioned further away from the fluid passageway than the north pole of the magnet. Preferably, the fluid passageway, north pole and south pole are arranged linearly such that the north pole is positioned between the fluid passageway and the south pole.

This arrangement induces a magnetic flux on fluid molecules travelling through the fluid passageway such that the molecules become negatively charged. In this negatively charged state, the fluid molecules tend to more quickly and evenly disperse within a combustion chamber once they enter the chamber. Combustion characteristics are thus improved by providing more efficient burning of the fuel. This produces more power and reduces emission of unburnt fuel.

In a preferred embodiment, two magnets are positioned on opposite sides of the fluid passageway. Each of the magnets is oriented such that its north pole is adjacent the fluid passageway and its south pole is spaced further from the fluid passageway than the north pole. More preferably, the two magnets are diametrically opposed in relation to the fluid passageway. Any number of magnets may be used. Pairs of magnets are preferred since opposing magnets repel each other and provide greater magnetic flux fields.

Preferably, the magnet(s) are housed in a housing which also provides a fluid passageway accommodating portion. The housing may be made of any suitable material such as plastic or metal and is preferably non-magnetic. A lid or cover may further be provided which attaches to the housing to secure it on the fluid passageway. The lid may be made of any suitable material such as plastic or metal and is preferably non-magnetic. The lid may attach to the housing by any conventional attachment means including a knob and recess arrangement, Velcro®, snaps, straps, hooks, pins, latches, adhesives and/or other fasteners.

Magnets suitable for use in the present invention may be composed of cobalt, nickel, aluminum, copper or iron, or any material which has a high retentivity and coercivity such as an Alnico material, ceramic, high carbon steel, or other steel alloys or some combination of these materials. Of these materials, ceramic magnets are preferred. Alternatively, electromagnets may be used. The magnet preferably has a curie temperature at least sufficiently high to retain magnetic characteristics at operating temperatures of an internal combustion engine. Also, the magnet preferably provides a magnetic flux field of at least 3200 gauss.

A metallic back plate may be provided on the south pole side of each magnet to produce a stronger magnetic flux field on the north pole side of the magnet. This can significantly increase the magnetic flux field in some instances. The metallic backplate is preferably non-magnetic steel.

Figure 2:
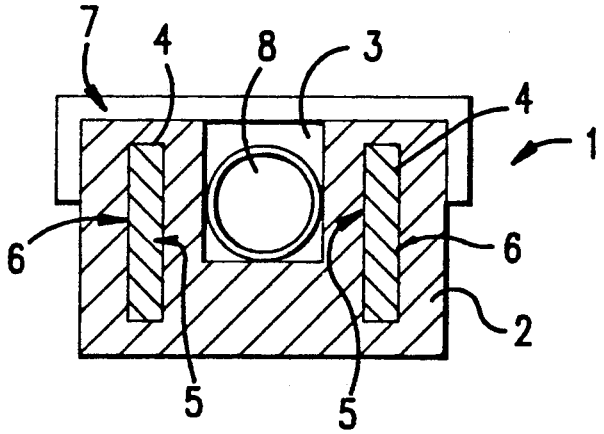
FIG. 2 is a cross-sectional view taken along plane A of FIG. 1.

Referring to FIGS. 1 and 2 of the drawings, a combustion efficiency improvement device 1 according to a preferred embodiment of the present invention comprises a non-magnetic housing 2 with a groove 3 therein. Two magnets 4 are encased in the non-magnetic housing 2, one on each side of the groove 3. Each magnet has a north pole 5 and a south pole 6.

A lid or cover 7, preferably made of a non-magnetic material, is placed over the housing 2 after the device has been placed on a fluid passageway 8 leading to a combustion apparatus, such as a fuel line, air intake line, two cycle gas/oil mix intake line, etc.

Figure 3:
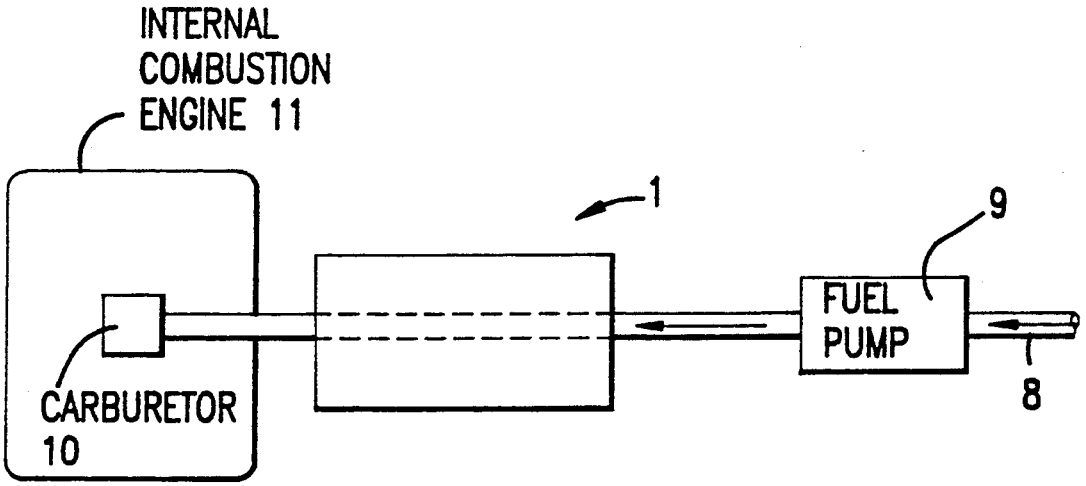
FIG. 3 is a schematic diagram showing the device of the present invention in relation to other components of a combustion apparatus.

Referring to FIG. 3, the combustion efficiency improvement device 1 is shown on a fuel line 8 downstream of a fuel pump 9 and upstream of a carburetor 10 of an internal combustion engine 11. The device is preferably attached as close as possible to the inlet of a carburetor, fuel injector or combustion chamber. The device may be used on gas turbine engines, furnaces, jet engines, diesel engines or other engines by attaching it to a fluid passageway leading to a combustion chamber (e.g., a fuel line, air intake line, etc.), or to the combustion chamber itself. The fluid (fuel, air, etc.) preferably is treated before it reaches the air-fuel mixing station, such as the carburetor, fuel injectors, etc.

As further shown in FIG. 3, liquid fuel flows from the fuel pump 9 through the combustion efficiency improvement device 1, and is subjected to the high density magnetic flux field produced by the device 1. The magnetic flux field negatively charges the fuel molecules, causing them to repel one another and to disperse more rapidly in the combustion chamber. This effects more complete combustion, resulting in greater fuel efficiency and performance and reduction of polluting exhaust emissions. By negatively charging fuel molecules with a high density magnetic flux field, the temperature at which the vapor of the fuel decomposes to a flammable gaseous mixture is lowered to a sufficient degree to eliminate preignition tendencies, resulting in yet additional power, improved fuel economy and reduced polluting emissions.

Figure 4:
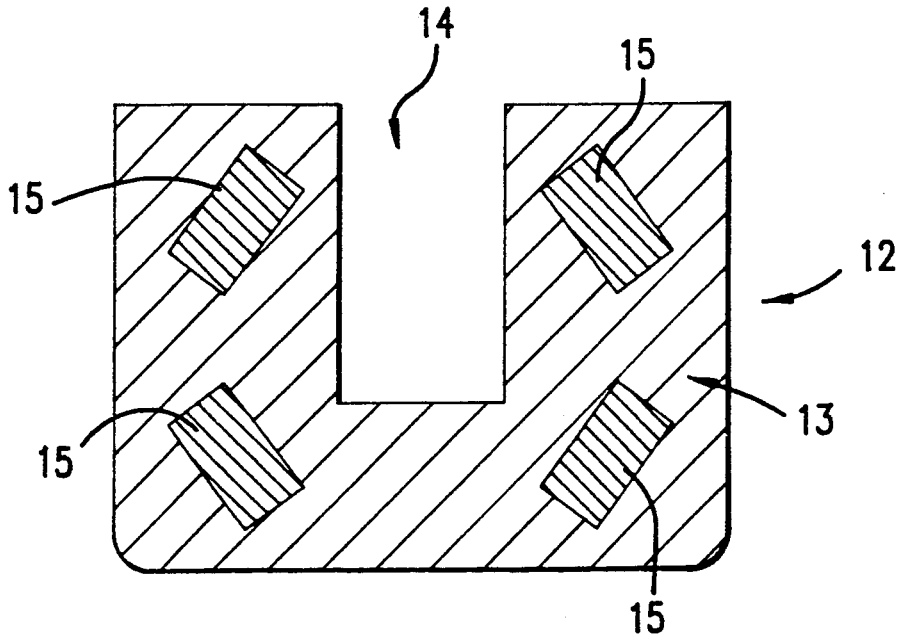
FIG. 4 is a cross-sectional view of an alternative embodiment of the present invention.

FIG. 4 shows an alternative embodiment of a combustion efficiency improvement device 12 of the present invention. The device 12 comprises a housing 13, a fluid passageway accommodating portion 14, and four magnets !5 positioned such that there are two pairs of diametrically opposed magnets.

Figure 5:
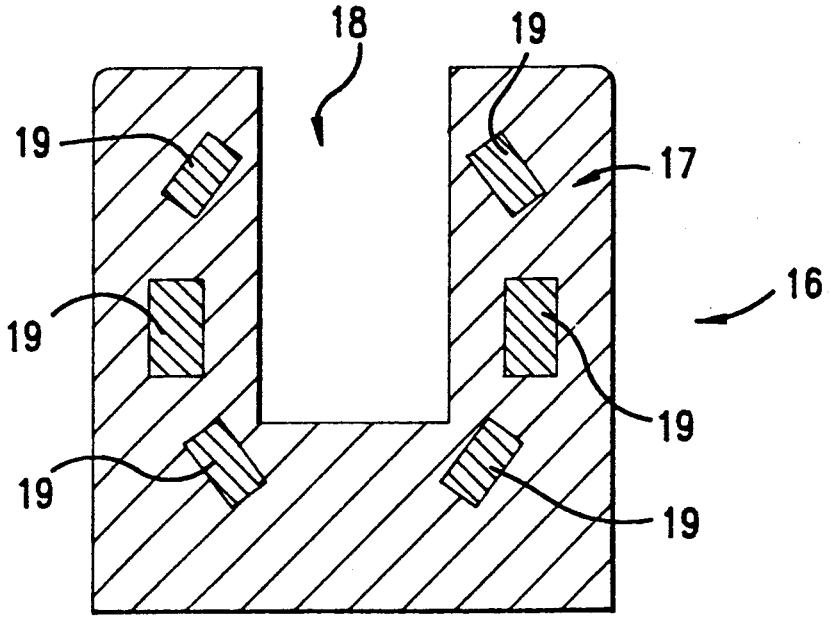
FIG. 5 is a cross-sectional view of another alternative embodiment of the present invention.

FIG. 5 shows another alternative embodiment of a combustion efficiency improvement device of the present invention. The device 16 comprises a housing 17, a fluid passageway accommodating portion 18 and six magnets 19 positioned in diametrically opposed pairs.

Figure 6:
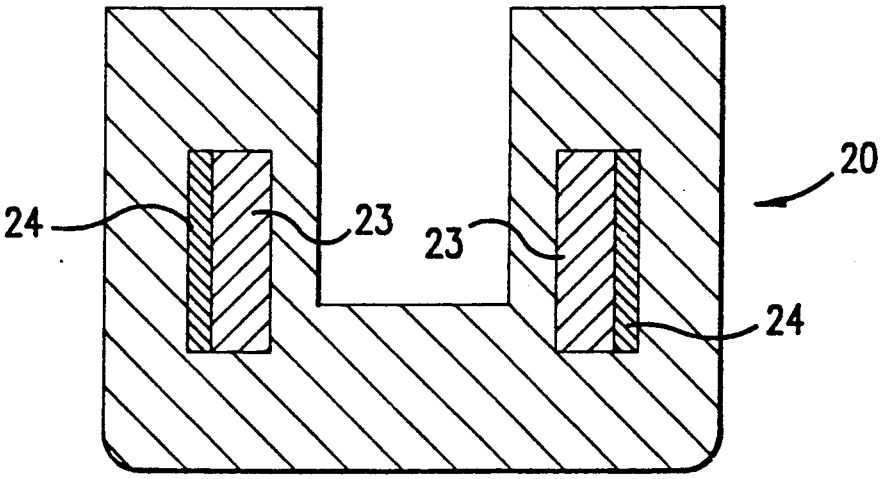
FIG. 6 is a cross-sectional view of yet another alternative embodiment of the present invention.

FIG. 6 shows yet another alternative embodiment of a combustion efficiency improvement device 20 according to the present invention wherein a metallic back plate 24 is provided on the south pole side of each magnet 23 so as to increase the magnetic flux field induced by the north pole side of each magnet.

In the embodiments shown in FIGS. 4–6, the magnets are arranged with their north poles closer to the fluid passageway accommodating portion than their south poles. Preferably, the fluid passageway accommodating portion and the north pole and the south pole of each magnet are arranged linearly as discussed above.

Devices and methods according to the present invention may further be useful in negatively charging any fluid travelling through a fluid passageway.

EXAMPLE

A 1990 model Plymouth Voyager having a six cylinder, 3.3 liter fuel injected engine was used to test a combustion efficiency improvement device according to the present invention. Comparative Example I was used as a control. Examples II and III show testing of a device comprising the same pair of magnets in each example wherein Example II used the magnets oriented in a manner in accordance with U.S. Pat. No. 4,461,262. Example III used the magnets oriented according to the FIG. 2 embodiment of the present invention.

In each of the three examples the same vehicle was used in a mix of city and highway driving along the same route, at the same time of day, under the same temperature and weather conditions. The route was 82 miles in length. The same 87 octane gasoline was used in all three examples.

I. As a control, the vehicle was run along the 82 mile route without a magnetic device attached to the fuel line. The vehicle traveled 20 miles per gallon over the 82 mile route.

II. The same vehicle used in Example I was tested along the same 82 mile route after having a magnetic combustion improvement efficiency device installed which was oriented in accordance with U.S. Pat. No. 4,461,262. The magnets used were each $\frac{7}{8}$ inch $\times$one and $\frac{7}{8}$ inch $\times$0.836 inch. The mileage increased to 22.3 miles per gallon over the 82 mile route.

III. The same vehicle as in Examples I and II was used and the same magnets as in Example II were used. The vehicle was run along the same 82 mile route. The magnets were oriented in accordance with the embodiment shown in FIG. 2 of the present invention. The mileage increased to 26.1 miles per gallon over the 82 mile route.

While this invention has been described in the attached illustrations and drawings in preferred embodiments, it will be appreciated by those skilled in the art that additions, modifications, substitutions and deletions not specifically described may be made without departing from the spirit and scope of the invention defined in the appended claims.

What is claimed is:

1. A device for improving the combustion efficiency of a combustion apparatus having a combustion chamber and a fluid passageway for carrying fluid to the combustion chamber, said device comprising:

at least one magnet positioned such that a north pole of said at least one magnet is adjacent said fluid passageway and a south pole of said at least one magnet is on an opposite side of said north pole from said fluid passageway, said at least one magnet providing a magnetic field of at least approximately 3200 gauss;

a mechanism for maintaining the position of said at least one magnet relative to said fluid passageway; and a metallic backing plate provided on the south pole of said at least one magnet.

2. A device for improving the combustion efficiency of a combustion apparatus having a combustion chamber and fluid passageway for carrying fluid to the combustion chamber, said device comprising:

at least two magnets positioned on substantially opposite sides of said fluid passageway, a north pole of each of said magnets being adjacent said fluid passageway and a south pole of each of said magnets being on an opposite side of said north pole from said fluid passageway, said at least two magnets providing a magnetic field of at least approximately 3200 gauss;

a metallic backing plate on the south pole of each of said at least two magnets;

a housing for maintaining the position of said at least two magnets relative to said fluid passageway; and means for attaching the housing to the fluid passageway without modification of said fluid passageway.

3. The device of claim 2, wherein said at least two magnets are comprised of a ceramic material.

4. A method of improving combustion efficiency in a combustion apparatus having a combustion chamber and fluid passageway for carrying fluid to the combustion chamber, said method comprising the steps of:

a) positioning north poles of at least two magnets adjacent said fluid passageway;

b) positioning south poles of said at least two magnets on opposite sides of said north poles from said fluid passageway;

c) providing metallic backing plates on the south poles of said at least two magnets;

d) providing a housing for maintaining the positions of said at least two magnets relative to said fluid passageway;

e) attaching the housing to said fluid passageway without modification of said fluid passageway;

f) negatively charging fluid molecules passing through said fluid passageway with a magnetic field from said at least two magnets of at least 3200 gauss; and g) combusting said negatively charged fluid molecules in said combustion chamber.

5. The method of claim 4, wherein said at least two magnets are comprised of a ceramic material.

* * * * *